United States Patent [19]

Shiew

[11] Patent Number: 5,075,984

[45] Date of Patent: Dec. 31, 1991

[54] REVERSIBLE HIKING SHOE HEEL-AND-TOE LIFT ATTACHMENT

[76] Inventor: James A. Shiew, P.O. Box 3134, Buena Vista, Colo. 81211

[21] Appl. No.: 633,808

[22] Filed: Dec. 26, 1990

[51] Int. Cl.[5] ..... A43B 3/00; A43B 5/00

[52] U.S. Cl. ..... 36/113; 36/114; 36/132; 36/81

[58] Field of Search ..... 36/113, 114, 115, 116, 36/132, 136, 81, 73, 97, 7.2, 7.4, 7.7

[56] References Cited

U.S. PATENT DOCUMENTS

| | | | |
|---|---|---|---|
| 380,395 | 4/1888 | Kramer . | |
| 681,959 | 9/1901 | Fenno | 36/114 |
| 754,577 | 3/1904 | Laub | 36/114 |
| 806,622 | 12/1905 | Baker et al. | 36/113 |
| 958,277 | 5/1910 | Phinny . | |
| 974,941 | 11/1910 | Wilkerson . | |
| 1,232,114 | 7/1917 | Sorley . | |
| 1,938,617 | 12/1933 | Augusta | 36/8.5 |
| 2,526,205 | 10/1950 | Doerschler | 128/94.5 |
| 3,204,348 | 9/1965 | Latson | 36/113 |
| 4,265,033 | 5/1981 | Pols | 36/110 |
| 4,546,557 | 10/1985 | Barouk et al. | 36/110 |
| 4,726,127 | 2/1988 | Barouk | 36/110 |

FOREIGN PATENT DOCUMENTS

| | | | |
|---|---|---|---|
| 83050 | 7/1983 | European Pat. Off. | 36/113 |
| 181796 | 10/1905 | Fed. Rep. of Germany | 36/114 |
| 306751 | 3/1933 | Italy | 36/114 |

*Primary Examiner*—Paul T. Sewell
*Assistant Examiner*—M. D. Patterson
*Attorney, Agent, or Firm*—John R. Flanagan

[57] ABSTRACT

A reversible hiking shoe heel-and-toe lift attachment is capable of being deployed on the heel of a hiking shoe for assisting a hiker in ascending a steep grade and on the toe of the hiking shoe for assisting the hiker in descending the steep grade. The lift attachment includes a support platform, a flexible confinement wall, and a flexible elastic strap. The support platform is inclined or wedge-shaped in a section taken through the platform along a longitudinal vertical plane extending between front and rear ends of the platform. The wedge-shaped or inclined platform is greater in height at the rear end than at the front end. The confinement wall is attached to and extends along and above the periphery of the support platform at the opposite sides and rear edges thereof for confining either the heel or toe of a hiking shoe when either the heel or toe is placed upon the support platform. The elastic strap is attached adjacent to opposite forward ends of the flexible confinement wall so as to form a loop capable of being stretched away from the support platform and confinement wall and correspondingly over the front or rear of a hiking shoe when either the heel or toe of the hiking shoe is placed upon the support platform and surrounded by the flexible confinement wall.

14 Claims, 2 Drawing Sheets

REVERSIBLE HIKING SHOE HEEL-AND-TOE LIFT ATTACHMENT

BACKGROUND OF THE INVENTION

1. Field of the Invention

The present invention generally relates to hiking equipment and, more particularly, is concerned with a reversible heel-and-toe lift attachment for deployment on a hiking shoe for assisting a hiker in ascending and descending steep grades with reduced risk of injury.

2. Description of the Prior Art

Hiking up and down steep terrain is an activity engaged in by an ever-increasing number of people. It permits participants to improve their physical fitness while, at the same time, enjoying the scenic beauty of hilly and mountainous terrain.

As in the case of any strenuous activity, proper physical conditioning and equipment should be employed in order to minimize the risk of injury during the activity. Ascending and descending steep grades produces substantial strain in the regions of a person's calf muscles, ankle tendons and muscles, and the Achilles tendon. During such activities, it is relatively easy for a hiker to exceed the limits imposed by age or state of physical condition, and produce injury to the muscles and tendons of the lower leg and ankle regions.

Shoe attachments for enabling workmen to walk and stand on a steeply pitched roof with their feet in substantially level planes are known in the prior patent art. Examples of such attachments are disclosed in U.S. Pat. No. 380,395 to Kramer, U.S. Pat. No. 958,277 Phinny, U.S. Pat. No. 974,941 Wilkerson, and U.S. Pat. No. 1,232,114 Sorley. However, none of these attachments is believed to be suitable for use on hiking shoes to assist in climbing steep grades. Other than by careful selection of properly constructed hiking shoes, up to the present time no equipment has been designed for use on hiking shoes to assist in climbing steep terrain and thus reduce strains and minimize risks of injuries to hikers' legs and feet.

Consequently, a pressing need still exists for the design of equipment to assist hikers in safely traversing up and down steep grades without subjecting themselves to calf and ankle strains which have a high probability of producing injury.

SUMMARY OF THE INVENTION

The present invention provides a reversible hiking shoe heel-and-toe lift attachment designed to satisfy the aforementioned needs. The lift attachment is capable of being deployed on the heel of a hiking shoe for assisting a hiker in ascending a steep grade and on the toe of the hiking shoe for assisting the hiker in descending the steep grade. Risk of injury is thereby reduced in each instance.

Basically, the reversible hiking shoe heel-and-toe lift attachment comprises: (a) means for supporting a heel and toe of a hiking shoe but not both at the same time so as to lift the supported one of the heel or toe of the shoe relative to the other to assist a hiker in ascending and descending a steep grade by maintaining the hiker's shoe at an inclination being less than that of the steep grade; and (b) means for releasably attaching the supporting means on the hiking shoe.

The supporting means of the lift attachment is a support platform being wedge-shaped in a section taken through the platform along a longitudinal vertical plane extending between front and rear ends of the platform. The wedge-shaped platform is greater in height at the rear end than at the front end of the platform and thus has an upper surface being inclined downwardly and forwardly from its rear to front ends.

The attaching means of the lift attachment includes a flexible confinement wall and a flexible elastic strap. The confinement wall is attached to and extends about and above the periphery of the support platform at the opposite side edges and rear edge thereof for confining either the heel or toe of the hiking shoe when placed upon the support platform. The elastic strap is attached to opposite forward ends of the flexible confinement wall so as to form a loop capable of being stretched away from the support platform and confinement wall and correspondingly over the front or rear of the hiking shoe when either the heel or toe of the hiking shoe is placed upon the support platform and surrounded by the flexible confinement wall.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
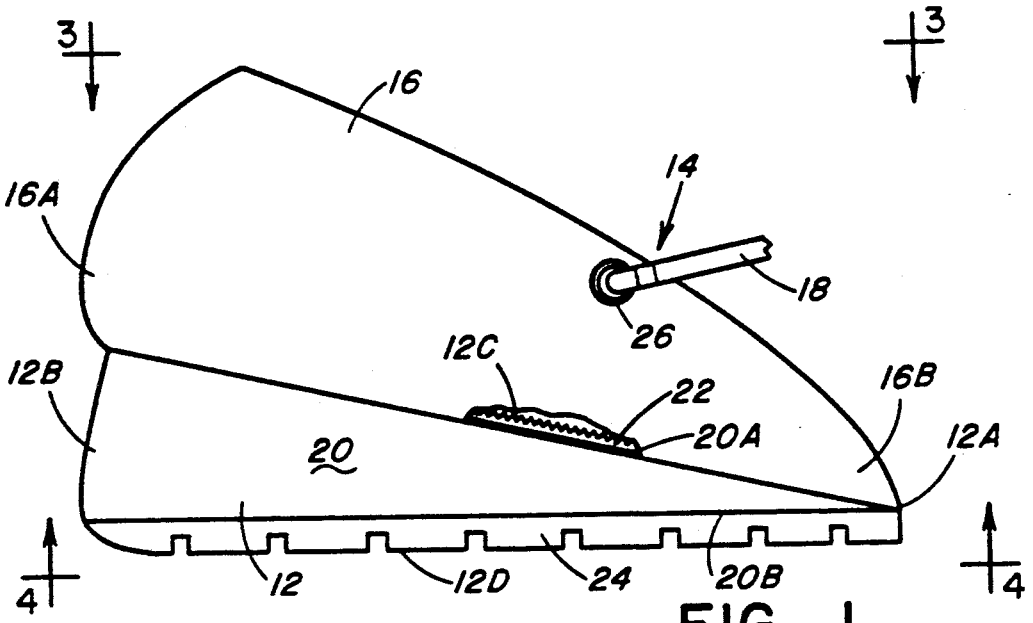
FIG. 1 is a side elevational view of a reversible hiking shoe heel-and-toe lift attachment of the present invention.
Figure 2:
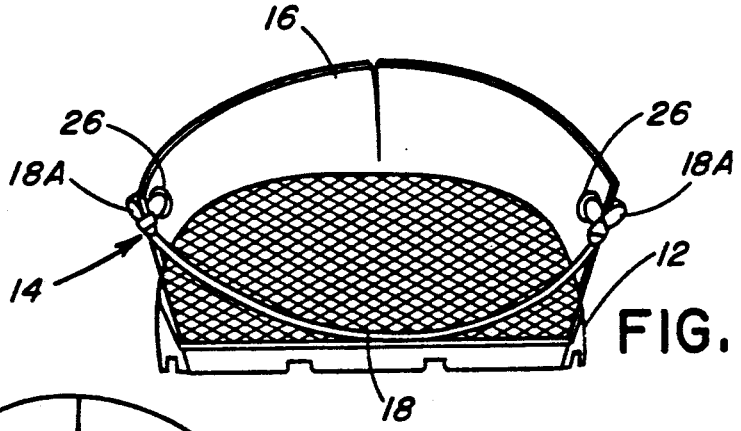
FIG. 2 is a front elevational view of the lift attachment as seen along line 2—2 of FIG. 1.
Figure 3:
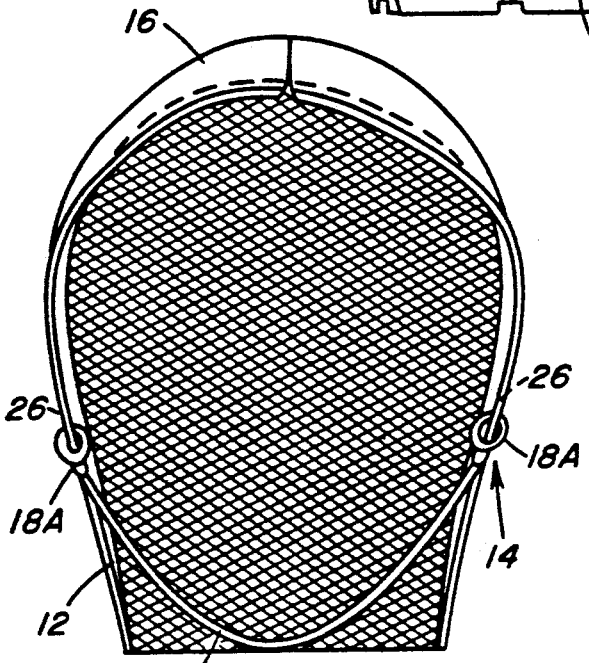
FIG. 3 is a top plan view of the lift attachment as seen along line 3—3 of FIG. 1.
Figure 4:
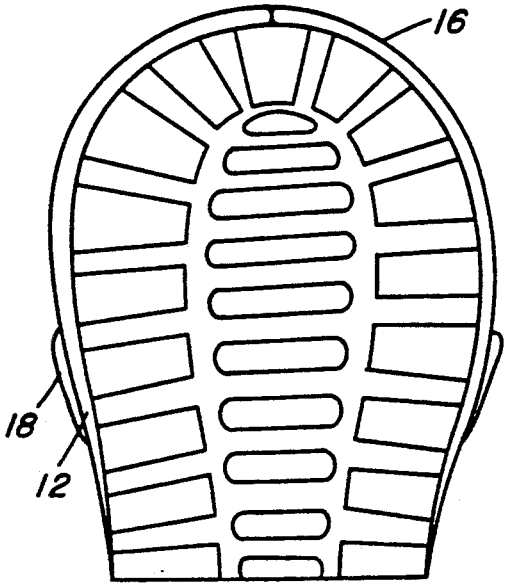
FIG. 4 is a bottom plan view of the lift attachment as seen along line 4—4 of FIG. 1.

In the following description, like reference characters designate like or corresponding parts throughout the several views of the drawings. Also in the following description, it is to be understood that such terms as "top", "bottom", "front", "rear" and the like, are words of convenience and are not to be construed as limiting terms.

Figure 5:
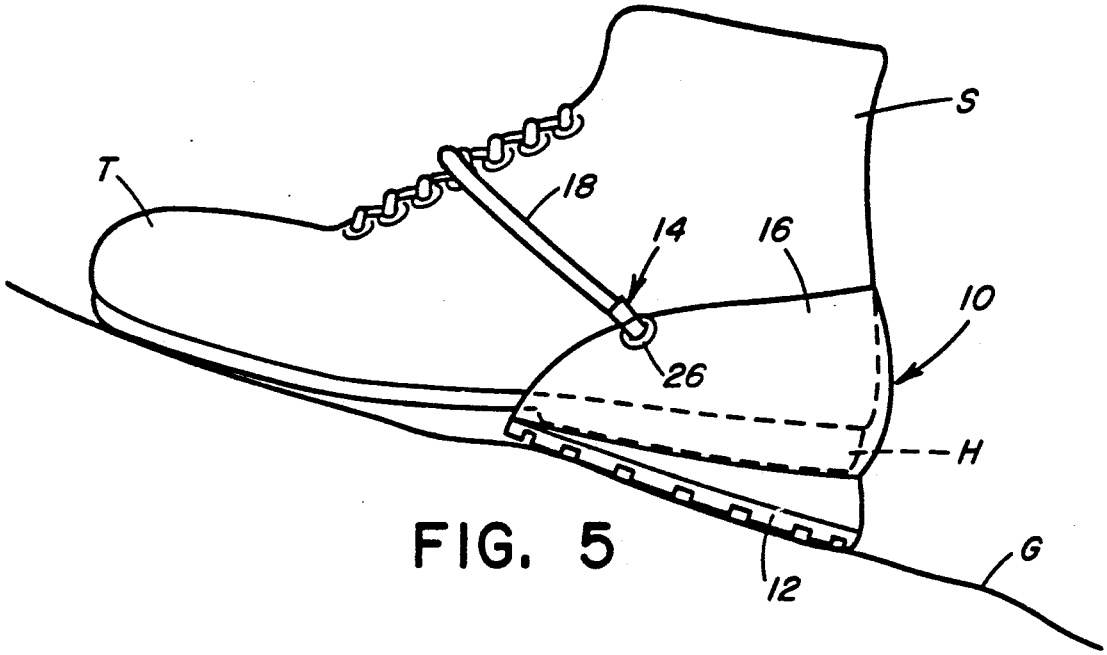
FIG. 5 is a side elevational view of the lift attachment applied to a hiking shoe for assisting in ascending a steep grade.
Figure 6:
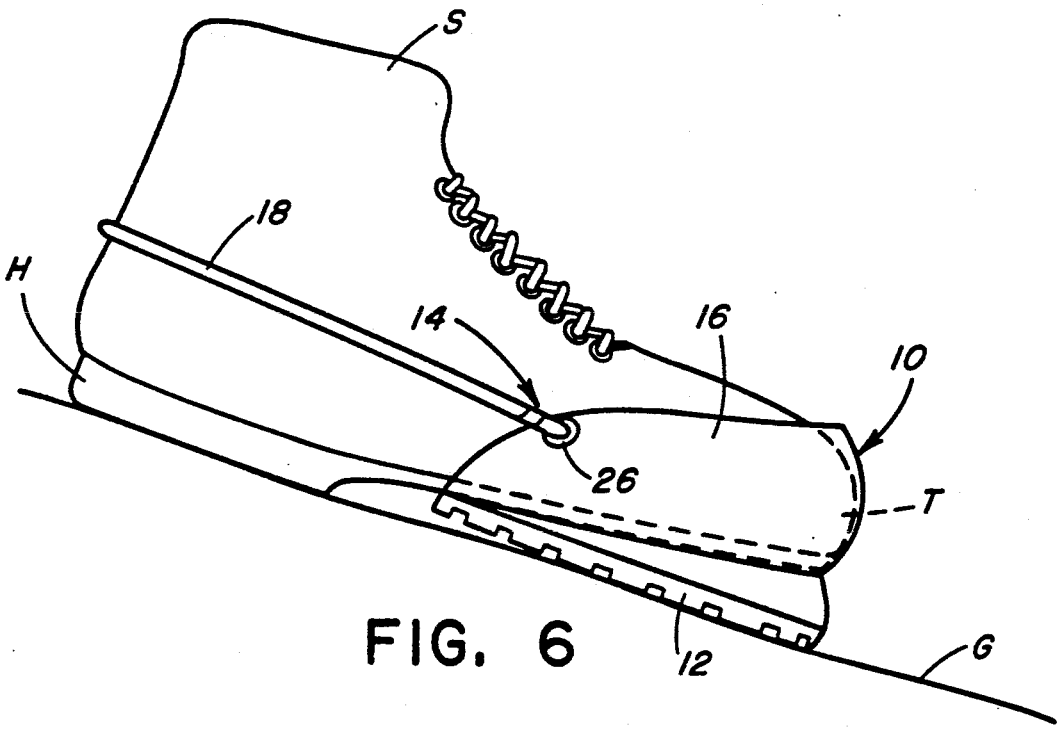
FIG. 6 is a side elevational view of the lift attachment applied to a hiking shoe for assisting in descending the steep grade.

Referring to the drawings, and particularly to FIGS. 1–4, there is illustrated a reversible hiking shoe heel-and-toe lift attachment of the present invention, being generally designated 10. As seen in FIGS. 5 and 6, the lift attachment 10 is capable of being deployed, at separate times, on the heel H of a hiking shoe S for assisting a hiker in ascending a steep grade G or on the toe T of the hiking shoe S for assisting the hiker in descending the steep grade G.

Basically, the lift attachment 10 includes means 12 for supporting the heel H and toe T of the hiking shoe S but not both at the same time and means 14 for releasably attaching the supporting means 12 on the hiking shoe S.

The supporting means 12 is preferably in the form of a wedge-shaped support platform 12. The wedge-shaped platform 12 is adapted to lift the supported one of the heel H or toe T of the shoe S relative to the other to assist the hiker in ascending and descending the steep grade G by maintaining the hiker's shoe S at an inclination being less than that of the steep grade G. The attaching means 14 is preferably in the form of a flexible confinement wall 16 and a flexible elastic strap 18.

More particularly, the support platform 12 of the lift attachment 10 is wedge-shaped in a section taken through the platform 12 along a longitudinal vertical plane extending between front and rear ends 12A, 12B of the platform. The wedge-shaped platform 12 is greater in height at the rear end 12B than at the front end 12A of the platform and thus has an upper surface 12C which is inclined downwardly and forwardly from its rear end 12B to front end 12A. As an example, the platform 12 can have a lift height at the rear of about 1½ inch, a length of about 5½ to 6 inches, and a width of about 3 to 4½ inches.

The platform 12 can have a multi-layer construction as seen in FIG. 1. The multi-layered platform 12 includes a middle layer 20 having the wedge-shaped configuration and being composed of a relatively stiff resilient material of the type commonly used in constructing heels of shoes, such as a rubber or crepe material. Also, the multi-layered platform 12 includes upper and lower layers 22, 24 of a relatively uniform thickness attached, such as by a suitable adhesive, on opposite top and bottom surfaces 20A, 20B of the middle layer 20. The upper and lower layers 22, 24 have respective traction patterns defined thereon which provides upper and lower traction surfaces 12C, 12D on the support platform 12. It should be realized that, just as likely, the platform 12 can be composed of a single layer or, in other words, have a one-piece construction, with the respective traction patterns integrally formed on the upper and lower surfaces 12C, 12D.

The confinement wall 16 of the lift attachment 10 is permanently attached to and extends about and above the periphery of the support platform 12 at the opposite sides and rear edge thereof. The confinement wall 16 is preferably composed of flexible but tough material, such as leather or other suitable synthetic material. The wall 16 at its rear end 16A is shaped in a semi-pocket, cupped configuration for receiving and confining either the heel H or toe T of the hiking shoe S on the support platform 12 when placed upon the platform 12. For example, the top edge of the rear end 16A of the wall 16 is located about ¼ inch forwardly of the bottom edge where the wall 16 connects to the platform 12 to assist in retaining the lift attachment 10 on the toe T of the hiking shoe S during descents.

The elastic strap 18 of the lift attachment 10 is attached at its opposite ends 18A to eyelets 26 fixed at the flexible confinement wall 16 nearer to the opposite forward ends 16B than to the rear end 16A thereof of the wall 16. The elastic strap 18 provides a loop capable of being stretched away from the support platform 12 and the confinement wall 16 and over either the front or rear of the hiking shoe S depending upon whether the heel H or toe T of the hiking shoe S is to be disposed upon the support platform 12 and confined by the cupped, semi-pocket configuration of the rear end 16A of the wall 16. The elastic strap 18 can be composed of any suitable stretchable resilient material, such as a hollow elastic tubing, known as surgical tubing or sling shot tubing, or an elastic rubber band material.

Referring to FIGS. 5 and 6, there is illustrated the lift attachment 10 during use. In FIG. 5, the lift attachment 10 is shown deployed in a first orientation solely on the heel H of the hiking shoe S for assisting a hiker in ascending the steep grade G. To install the lift attachment 10 for use in ascending the steep grade G, first, the elastic strap 18 is looped over and moved upwardly past the toe T of the shoe S and then released about the front of the laced section of the shoe S. Then, the support platform 12 is pulled against the tension of the elastic strap 18, stretching the same, and placed under the heel H of the hiking shoe S such that the confinement wall 16 cups around the sides and rear of the heel H and lower back of the hiking shoe S.

In FIG. 6, the lift attachment 10 is shown deployed in a second orientation solely on the toe T of the hiking shoe S for assisting the hiker in descending the steep grade G. For use in descending the grade G, the lift attachment 10 is removed from the heel H, and its orientation is reversed. It is installed by, first, stretching the elastic strap 18 past the rear of the heel H of the shoe S and moving it upwardly past the heel H where it is then released to overlie the back of the shoe S. Then, the support platform 12 is pulled forwardly against the tension of the elastic strap 18, stretching the same, and placed under the toe T of the hiking shoe S such that the confinement wall 16 nows cups around the toe T of the shoe A. For purposes of definition, as shown in FIG. 6, the toe T of the hiking shoe S, which the wedge-shaped support platform 12 underlies and supports, is that front portion of the sole of the hiking shoe which supports the ball and toes of the hiker's foot.

To summarize, the lift attachment 10 facilitates hiking up and down steep grades, for instance, grades of six percent or more going up and ten percent or more coming down. The platform 12 of the attachment 10 lifts the heel H of the shoe S for supporting the hiker's foot closer to a level or horizontal plane while going up a trail and lifts the toe T of the shoe S for also supporting the hiker's foot closer to a horizontal plane while going down the trail. The stretched single elastic strap 18 holds the lift attachment 10 in place both during ascents and descents.

The lift attachment 10 saves the hiker's energy and reduces strain on the calf muscles and Achilles' Tendon for ascents by lifting the foot to the more level position. This, in turn, transfers more of the work to the thigh muscles of the hiker which are better able to assume the load. On the descent, the lift attachment 10 being placed on the toe T also keeps the foot in a more level position thus simulating walking down steps.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. A reversible hiking shoe heel-and-toe lift attachment, comprising:

(a) a support platform capable of being disposed in a first orientation solely underlying a heel of a hiking shoe for solely supporting the heel of the hiking shoe so as to lift the supported heel relative to an unsupported toe of the shoe to assist a hiker in ascending a steep grade by maintaining the hiker's shoe at an inclination being less than that of the steep grade, said support platform also capable of being disposed in a second orientation, substantially the reverse of said first orientation, solely underlying the toe of the hiking shoe for solely supporting the toe of the hiking shoe so as to lift the supported toe relative to the unsupported heel of the shoe to assist the hiker in descending a steep grade by maintaining the hiker's shoe at an inclination being less than that of the steep grade; and (b) means for releasably attaching said support platform on the hiking shoe, said attaching means including (i) a flexible confinement wall being attached to and extending along and above a periphery of said support platform at the opposite side edges and rear edge thereof for solely confining the heel of the hiking shoe when said platform is in said first orientation and for solely confining the toe of the hiking shoe when said platform is in said second orientation, and (ii) means attached adjacent to opposite forward ends of said flexible confinement wall for forming a securing loop capable of extending from said confinement wall and over solely a front of the hiking shoe when said platform is in said first orientation and over solely a rear of the hiking shoe when said platform is in said second orientation.

2. The lift attachment of claim 1 wherein said support platform is wedge-shaped in a section taken through the platform along a longitudinal vertical plane extending between front and rear ends of said platform.

3. The lift attachment of claim 1 wherein said support platform is greater in height at the rear end than at the front end and thus has an upper surface being inclined in a downwardly and forwardly direction from its rear to front ends.

4. The lift attachment of claim 1 wherein said support platform has a multi-layered construction.

5. The lift attachment of claim 2 wherein said platform includes a middle portion having said wedge-shaped configuration and being composed of a relatively stiff resilient material.

6. The lift attachment of claim 5 wherein said platform also includes upper and lower portions disposed on opposite upper and lower sides of said middle portion and defining respective upper and lower traction surfaces.

7. The lift attachment of claim 1 wherein said support platform has respective upper and lower traction surfaces.

8. A reversible hiking shoe heel-and-toe lift attachment, comprising:

(a) a support platform capable of being disposed in a first orientation solely underlying a heel of a hiking shoe for solely supporting the heel of the hiking shoe so as to lift the supported heel relative to an unsupported toe of the shoe to assist a hiker in ascending a steep grade by maintaining the hiker's shoe at an inclination being less than that of the steep grade, said support platform also capable of being disposed in a second orientation, substantially the reverse of said first orientation, solely underlying the toe of the hiking shoe for solely supporting the toe of the hiking shoe so as to lift the supported toe relative to the unsupported heel of the shoe to assist the hiker in descending a steep grade by maintaining the hiker's shoe at an inclination being less than that of the steep grade;

(b) a flexible confinement wall attached to and extending about and above the periphery of said support platform at opposite side edges and a rear edge thereof for solely confining the heel of the hiking shoe when said platform is in said first orientation and for solely confining the toe of the hiking shoe when said platform is in said second orientation; and (c) an elastic strap attached adjacent to opposite forward ends of said flexible confinement wall so as to form a securing loop capable of being stretched away from said support platform and confinement wall and correspondingly over solely a front of the hiking shoe when said platform is in said first orientation and over solely a rear of the hiking shoe when said platform is in said second orientation.

9. The lift attachment of claim 8 wherein said support platform is wedge-shaped in a section taken through the platform along a longitudinal vertical plane extending between front and rear ends of said platform.

10. The lift attachment of claim 8 wherein said support platform is greater in height at the rear end than at the front end and thus has an upper surface being inclined in a downwardly and forwardly direction from its rear to front ends.

11. The lift attachment of claim 8 wherein said support platform has a multi-layered construction.

12. The lift attachment of claim 11 wherein said platform includes a middle portion having said wedge-shaped configuration and being composed of a relatively stiff resilient material.

13. The lift attachment of claim 12 wherein said platform also includes upper and lower portions disposed on opposite upper and lower sides of said middle portion and defining respective upper and lower traction surfaces.

14. The lift attachment of claim 13 wherein said support platform has respective upper and lower traction surfaces.

* * * * *